US012319481B2

(12) United States Patent
Busby

(10) Patent No.: US 12,319,481 B2
(45) Date of Patent: Jun. 3, 2025

(54) YARN STORAGE SYSTEM

(71) Applicant: YARNDLES, LLC, Wilmington, DE (US)

(72) Inventor: Antonisha Busby, Wilmington, DE (US)

(73) Assignee: YARNDLES, LLC, Wilmington, DE (US)

( * ) Notice: Subject to any disclaimer, the term of this patent is extended or adjusted under 35 U.S.C. 154(b) by 54 days.

(21) Appl. No.: 18/312,762

(22) Filed: May 5, 2023

(65) Prior Publication Data

US 2023/0356898 A1 Nov. 9, 2023

Related U.S. Application Data

(60) Provisional application No. 63/339,073, filed on May 6, 2022.

(51) Int. Cl.

| | |
|---|---|
| ***B65D 51/18*** | (2006.01) |
| ***B65D 43/02*** | (2006.01) |
| ***B65D 51/24*** | (2006.01) |
| ***B65D 53/02*** | (2006.01) |
| ***B65D 85/04*** | (2006.01) |

(52) U.S. Cl.

CPC ..... *B65D 51/18* (2013.01); *B65D 43/0202* (2013.01); *B65D 51/245* (2013.01); *B65D 53/02* (2013.01); *B65D 85/04* (2013.01); *B65D 2543/00092* (2013.01)

(58) Field of Classification Search

CPC .... B65D 43/02; B65D 43/0202; B65D 51/18; B65D 51/245; B65D 53/02; B65D 81/30; B65D 85/04; B65D 2543/00092

USPC ..... 206/392, 459.5

See application file for complete search history.

(56) References Cited

U.S. PATENT DOCUMENTS

| | | | | |
|---|---|---|---|---|
| 1,941,087 | A * | 12/1933 | Hejduk | D06F 73/02 34/105 |
| 1,996,791 | A * | 4/1935 | Blake | B65D 85/04 242/159 |
| 2,195,935 | A * | 4/1940 | Nuyts | A61L 2/26 206/209.1 |
| 4,124,117 | A * | 11/1978 | Rudy | A63B 39/025 206/315.9 |
| 2015/0166210 | A1* | 6/2015 | Schram | G06Q 90/00 206/459.5 |
| 2023/0061781 | A1* | 3/2023 | Fernandez-Prieto | B65D 81/30 |

* cited by examiner

*Primary Examiner* — Bryon P Gehman

(74) *Attorney, Agent, or Firm* — McCarter & English, LLP

(57) ABSTRACT

Exemplary embodiments are directed to a yarn storage system. The yarn storage system includes a container and a lid removably coupled to the container. The container includes an interior configured to receive yarn. The yarn storage system includes a scent diffusion assembly positioned within the container. The scent diffusion assembly includes a scent source configured to diffuse a scent from the scent source to the yarn positioned within the container.

18 Claims, 5 Drawing Sheets

YARN STORAGE SYSTEM

CROSS-REFERENCE TO RELATED APPLICATIONS

This application claims priority to and the benefit of U.S. Provisional Patent Application No. 63/339,073, filed on May 6, 2022. The entire content of the foregoing provisional application is incorporated herein by reference.

TECHNICAL FIELD

The present disclosure relates to a yarn storage system and, in particular, to a yarn storage system that provides an organized means for storing yarn with an optional scent infusion assembly within the storage system.

BACKGROUND

Yarn is used for a variety of purposes, such as knitting or crocheting. Yarn is generally packaged as a ball (e.g., wrapped in a ball shape), a skein (e.g., wrapped in a loose twist), or a hank (e.g., wound in a large circle and folded) configuration. In some instances, the prepackaged yarn can be wound into a cake, which allows for the end of the yarn to be pulled from the center of the cake for knitting or crocheting. Such cake configuration therefore provides a more convenient means for continuously using the yarn. In each of these configurations, after use, the yarn is generally stored in bags and/or plastic containers to prevent unwinding of the yarn or damage to the yarn. However, even with such storage, the yarn can become loose and/or tangled.

Thus, a need exists for a yarn storage system that provides for convenient storage and access of yarn. These and other needs are addressed by the yarn storage system of the present disclosure.

SUMMARY

In accordance with embodiments of the present disclosure, an exemplary yarn storage system is provided. The yarn storage system includes a container and a removable lid engaged with the container to allow for convenient and efficient storage of the yarn. The container includes an inner cover positionable over the stored yarn to reduce damage to the yarn and to assist with removal/pulling of the yarn end from container. The system can include a scent infusing assembly removably coupled to the lid to diffuse a desired scent into the container, thereby imparting a scent on the stored yarn.

In accordance with embodiments of the present disclosure, an exemplary yarn storage system is provided. The yarn storage system includes a container and a lid removably coupled to the container. The container includes an interior configured to receive yarn. The yarn storage system includes a scent diffusion assembly positioned within the container. The scent diffusion assembly includes a scent source configured to diffuse a scent from the scent source to the yarn positioned within the container.

The container includes a bottom surface and an opposing top edge. The top edge includes an opening extending into the interior of the container. In some embodiments, the container can define a substantially cylindrical configuration. The lid includes a bottom surface and an opposing top surface. The bottom surface faces the interior of the container when the lid is removably coupled to the container. In some embodiments, the yarn storage system can include an artistic design coupled to the top surface of the lid. In such embodiments, the artistic design can correspond with the scent diffused from the scent diffusion assembly. In some embodiments, the artistic design can be unrelated to the scent to be diffused from the scent diffusion assembly.

The yarn storage system includes a seal secured to the bottom surface of the lid. The seal defines a diameter complementary to the diameter of an opening in a top surface of the container. Due to the seal, the lid removably coupled to the container creates an air tight connection between the seal and an inner surface of the container.

The scent diffusion assembly can be removably coupled to the bottom surface of the lid. In some embodiments, the scent diffusion assembly can be fixedly coupled to the bottom surface of the lid. The scent source can be disposed within a capsule (e.g., a hollow chamber or body). The capsule includes one or more openings formed therein. The openings permit diffusion of the scent from the scent diffusion assembly to the interior of the container. In some embodiments, the scent source can be at least one of an oil or a gel, or a combination of both. In some embodiments, the scent source can replaceable (e.g., a new capsule can be secured to the lid or the existing capsule can be refilled).

The yarn storage system can include an inner cover disposed within the interior of the container. The inner cover can be configured to be positioned over the yarn. The inner cover includes a central opening configured to receive an end of the yarn therethrough. The inner cover can include a tab extending from a perimeter edge. In some embodiments, the yarn can be a cake of yarn.

In accordance with embodiments of the present disclosure, an exemplary method of yarn storage is provided. The method includes positioning yarn within an interior of a container of a yarn storage system. The yarn storage system includes a lid and a scent diffusion assembly with a scent source. The method includes removably coupling the lid to the container. The method includes diffusing a scent from the scent source of the scent diffusion assembly to the yarn positioned within the container.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed yarn storage system, reference is made to the accompanying figures, wherein.

DESCRIPTION OF EXEMPLARY EMBODIMENTS

Figure 1:
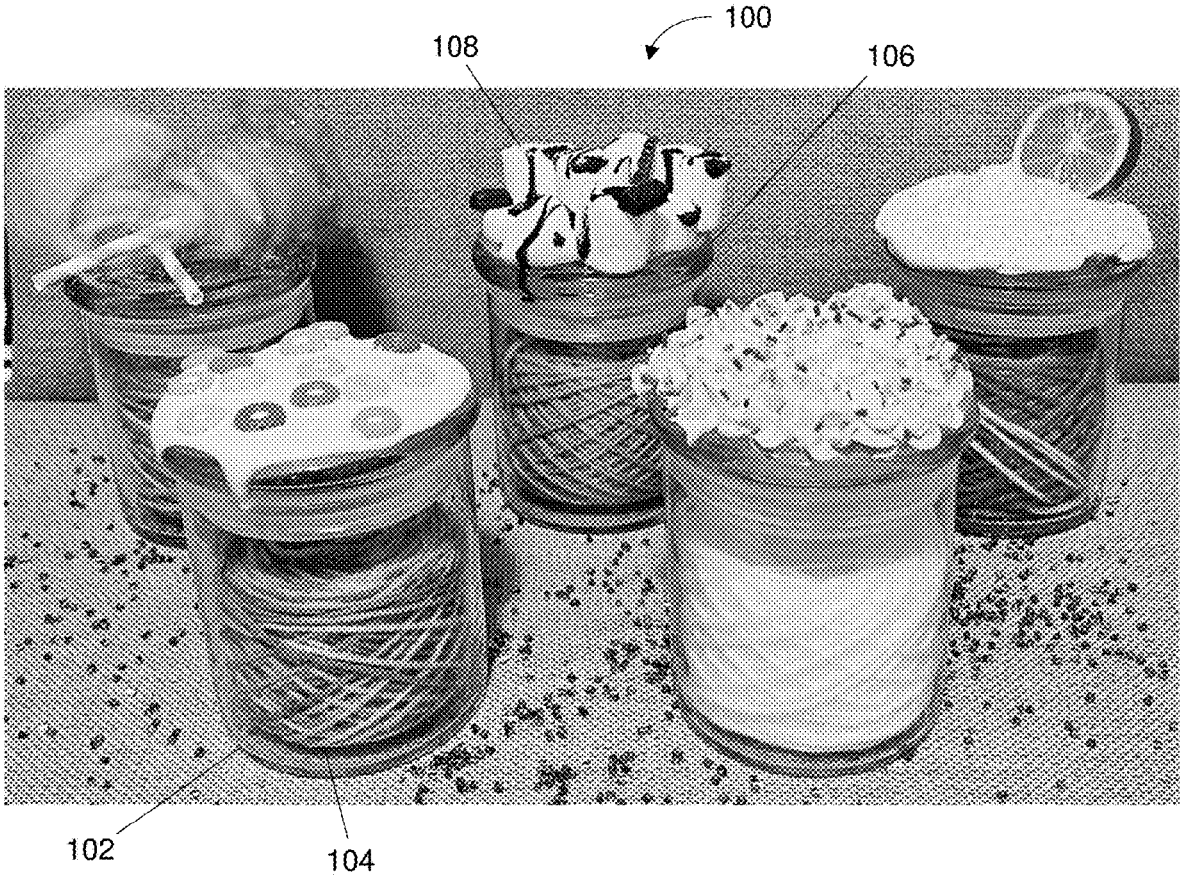
FIG. 1 is a perspective view of yarn storage systems according to the present disclosure.

FIG. 1 is a perspective view of yarn storage systems 100 (hereinafter referred to as "system 100") having different lid designs. Each system 100 includes a container 102 configured to receive yarn 104, and a lid 106 configured to be detachably coupled with the container 102. Although illustrated as storing a cake of yarn 104, it should be understood that the system 100 can be used to store yarn 104 in any configuration. In some embodiments, rather than yarn 104, the system 100 can be used to neatly store and disburse other crafting items, such as thread. The lid 104 can optionally include a design 108 (e.g., an artistic design) on an outer/top surface of the lid 104.

As discussed herein, the system 100 can include a scent infusion assembly (see, e.g., FIGS. 4-5) for infusing a predetermined scent into the yarn 104 being stored in the system 100. The scent can be infused into the yarn 104 (or any other items stored within the container 102) so long as the yarn 104 or other items are fabricated from a permeable material. In some embodiments, such other items can include, e.g., pipe cleaners, pom-poms, fabric pieces, or the like. In some embodiments, the scent to be infused into the yarn 104 can match with the design 108 on the lid 104. For example, the system 100 having the marshmallow and chocolate design 108 can include a scent infusion assembly that infuses a scent of s'mores to the yarn 104. As a further example, the system 100 having the lime design 108 can include a scent infusion assembly that infuses a scent of key lime pie to the yarn 104. In some embodiments, the scents can be customized and prepared using a combination of oils. In some embodiments, the designs 108 can be handmade.

Figure 2:
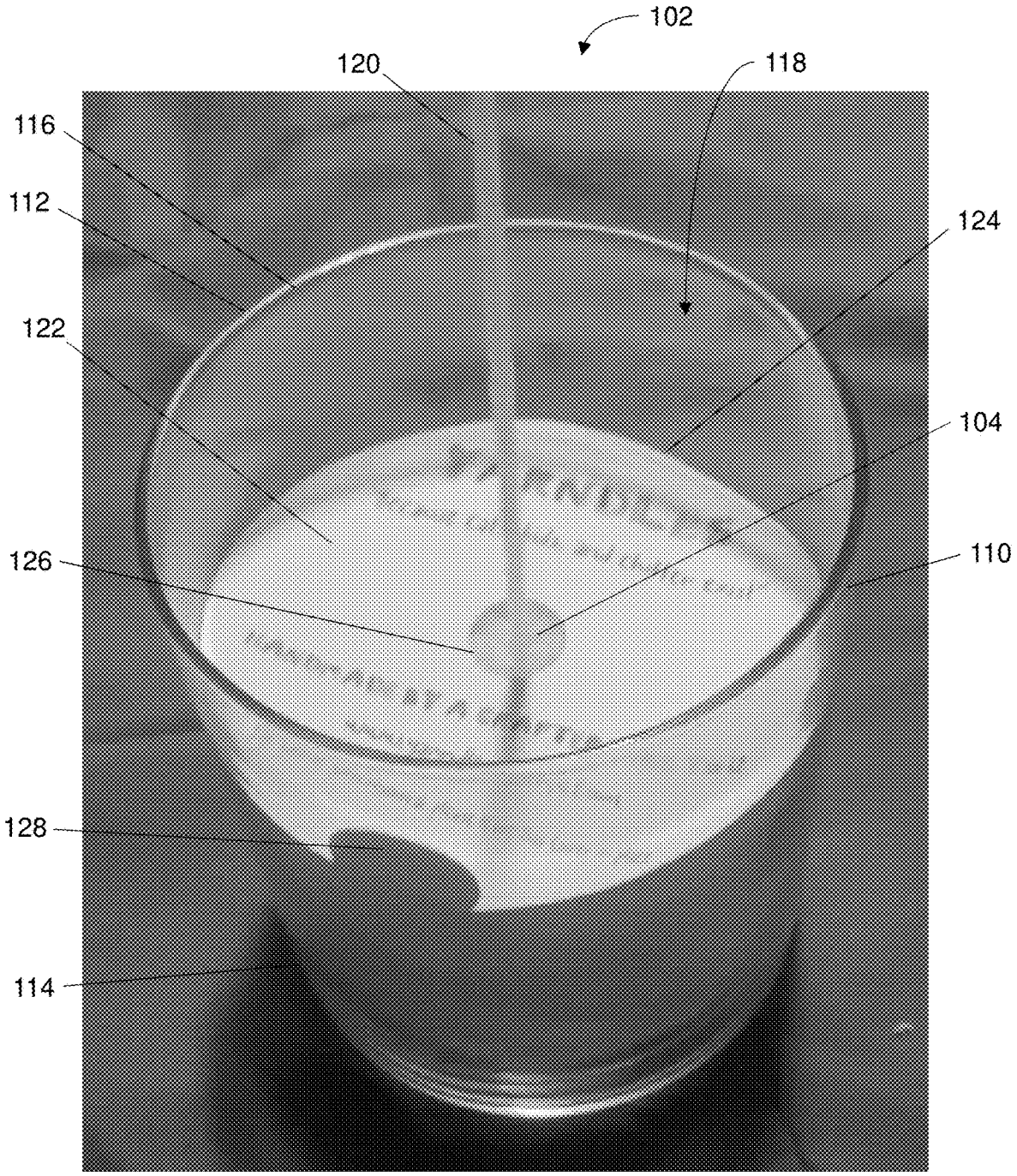
FIG. 2 is a perspective view of a container of a yarn storage system according to the present disclosure.

With reference to FIG. 2, a perspective view of the container 102 of the system 100 is provided. The container 102 generally includes a body 110 fabricated from glass, plastic or metal. In some embodiments, the body 110 can be clear, allowing for visual inspection of the contents of the system 100. In some embodiments, the body 110 can define a substantially cylindrical configuration extending between a top surface or edge 112 and a bottom surface or edge 114. In some embodiments, the configuration of the body 110 can be, e.g., square, oval, rectangular, or the like. In some embodiments, the outer walls of the body 110 can be substantially parallel (e.g., perpendicularly extending from the bottom surface or edge 114). In some embodiments, the outer walls of the body 110 can taper outward such that the diameter at the bottom surface or edge 114 is dimensioned smaller than the diameter at the top surface or edge 112.

The container 102 includes an opening 116 formed at the top surface or edge 112. The opening 116 extends into the interior 118 of the container 102. The interior 118 is configured and dimensioned to receive at least one cake of yarn 104. For example, the cake of yarn 104 can be inserted into the interior 118 of the container 102 such that the central longitudinal axis of the yarn 104 substantially aligns with the central longitudinal axis of the container 102. In such position, the end 120 of the yarn 104 can be pulled out in an upwards direction along the central longitudinal axis (as shown in FIG. 2). In some embodiments, the container 102 can be dimensioned such that only a single cake of yarn 104 is capable of being positioned on the inner bottom surface of the container 102. In some embodiments, the container 102 can be sized to accommodate two cakes of yarn 104 stacked on top of each other.

The system 100 can optionally include a cover 122 (e.g., a dust cover) removably positioned over the yarn 104. The cover 122 can be fabricated from, e.g., paper, cardboard, plastic, metal, rubber, or the like. In some embodiments, a thick cardstock can be used for fabrication of the cover 122 to ensure the cover 122 remains rigid and/or heavy enough to maintain its position over the yarn 104. The cover 122 generally defines a substantially circular configuration dimensioned to fit and remain at about the central height within the interior 118 of the container 102. For example, the diameter at the outer edge 124 of the cover 122 can be dimensioned greater than the diameter of the container 102 at the bottom surface or edge 114 and smaller than the diameter of the container 102 at the top surface or edge 112. The cover 122 can rest on top of the yarn 104 with the yarn 104 at least partially providing support to the cover 122.

The cover 122 includes a central opening 126 that allows the end 120 of the yarn 104 to be pulled through for use. The cover 122 includes a tab 128 extending from the outer edge 124. The tab 128 can be bent upwards against the inner surface of the container 102 when the cover 122 is installed over the yarn 104. The tab 128 can be used to pull on and remove the cover 122 from the interior 118 of the container 102 when replacing the yarn 104. The tab 128 can also assist with repositioning the cover 122 after the cake of yarn 104 has been placed within the container 102. As the yarn 104 is being used and the size of the yarn 104 within the container 102 is reduced, the position of the cover 122 can gradually lower within the container 102 while maintaining its position on the top surface of the yarn 104. As such, the cover 122 is movably disposed within the container 104, with the position of the cover 122 within the container 104 continuously changing as the yarn 104 is used. The cover 122 thereby protects the yarn 104 from outside particles, such as dust, and provides for an organized means for storing and using the end 120 of the yarn 104 without having to remove the entire cake of yarn 104 from the container 102.

Figure 3:
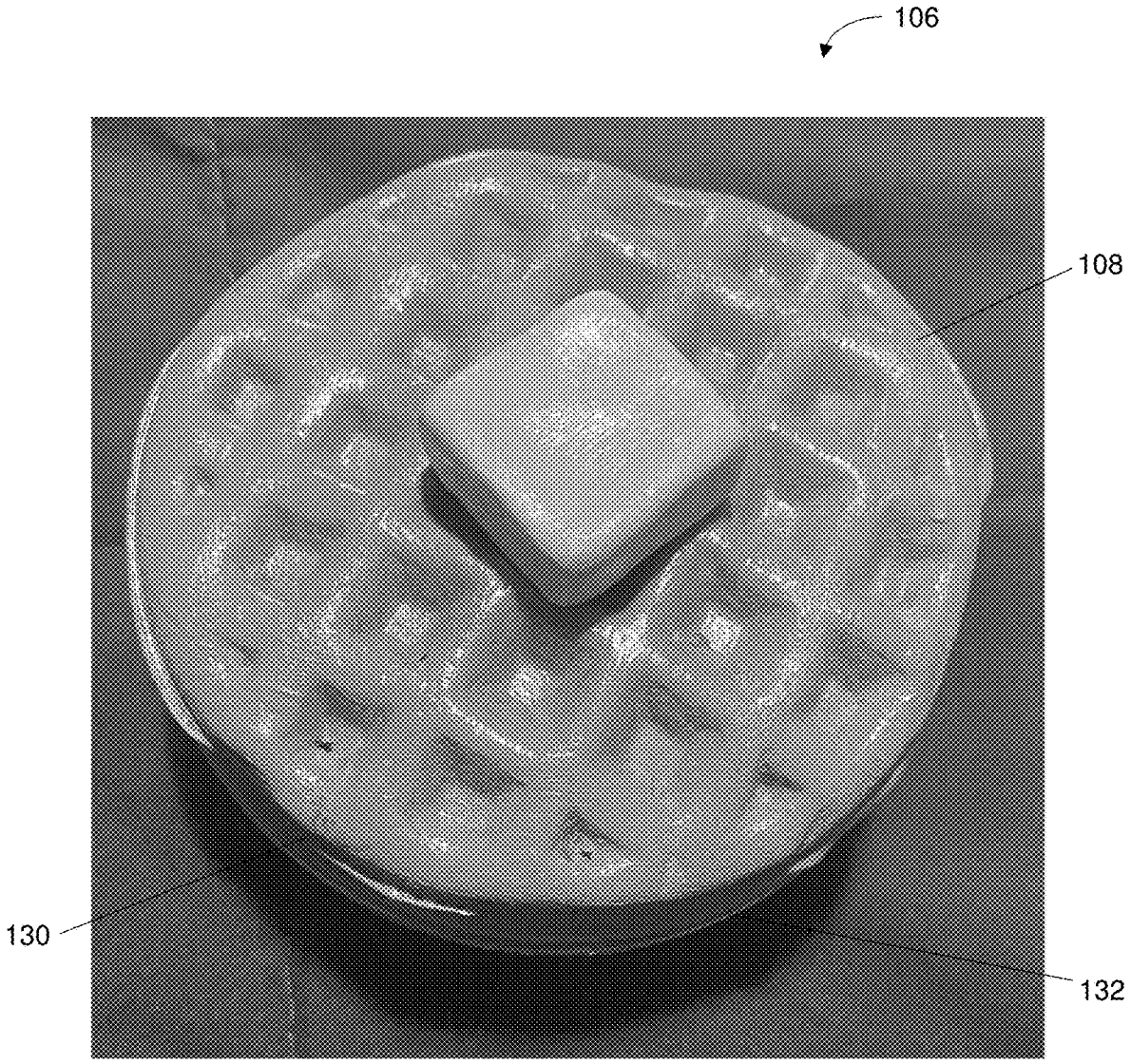
FIG. 3 is a top view of a lid of a yarn storage system according to the present disclosure.
Figure 4:
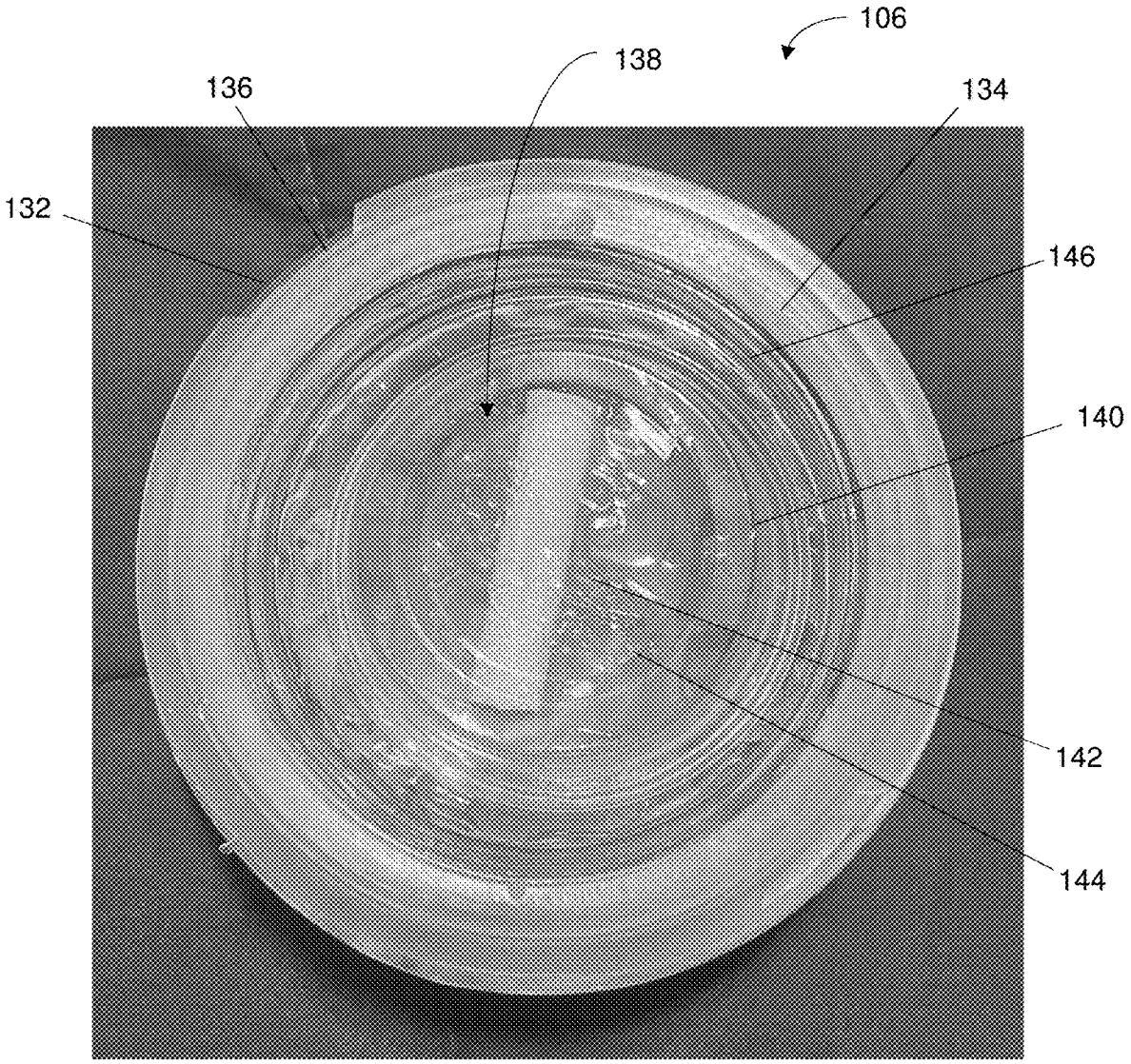
FIG. 4 is a bottom view of a lid of a yarn storage system according to the present disclosure.

FIGS. 3 and 4 are top and bottom views of the lid 106 of the system 100. The lid 106 includes a top surface 130 and an opposing bottom surface 132. The lid 106 generally defines a circular or cylindrical configuration with a diameter complementary to the diameter of the opening 116 in the container 102. For example, the diameter of the lid 106 can be dimensioned greater than the opening 116 such that the lid 106 sits over the container 102 when engaged with the opening 116. The lid 106 can therefore be used to selectively open and close the container 102. The top surface 130 can optionally include the design 108. The design 108 can act as a handle for ease of disengagement and removal of the lid 106 from the container 102. Alternatively, the top surface 130 can include a handle for disengagement and removal of the lid 106 from the container 102. In some embodiments, the perimeter of the lid 106 can be grasped and used to disengage and remove the lid 106 from the container 102.

The bottom surface 132 of the lid 106 includes a seal 134 that circumferentially extends at or near the outer edge of the bottom surface 132. The seal 134 can be fabricated from, e.g., rubber, thereby providing flexibility for engagement with the opening 116 of the container 102. The diameter of the seal 134 can be dimensioned substantially equal to the diameter of the opening 116 such that when the seal 134 is pressed into the opening 116, the seal 134 compresses slightly to create an air tight seal with the inner perimeter of the opening 116. The circumferential positioning of the seal 134 ensures that the air tight seal is created along the entire perimeter of the lid 106. In some embodiments, the seal 134 can optionally include a cutout 136 at one perimeter edge. In some embodiments, the seal 134 can extend along the entire circumference of the lid 106, i.e., without to cutout 136.

Figure 5:
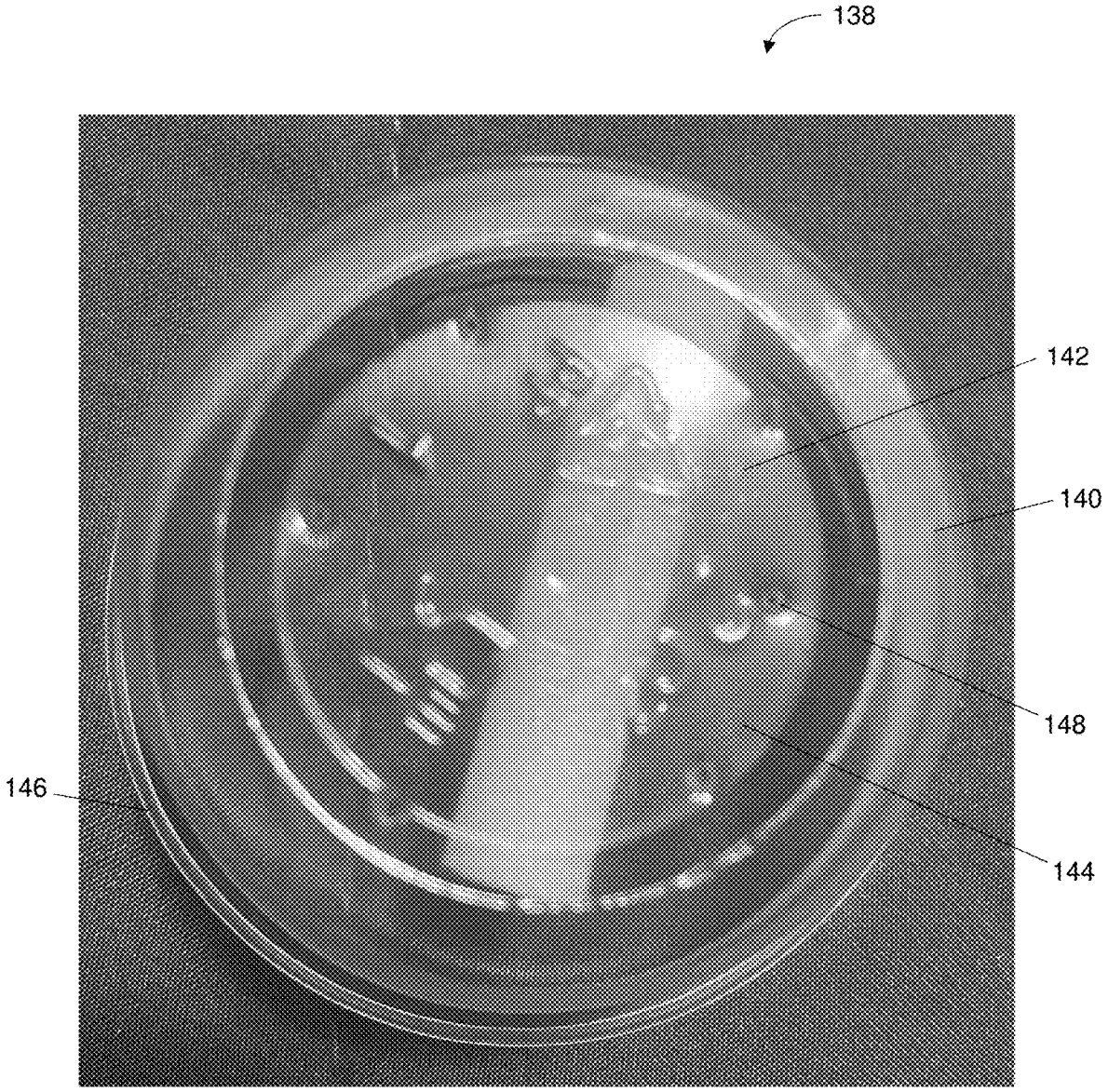
FIG. 5 is a perspective view of a scent infusion assembly of a yarn storage system according to the present disclosure.

The lid 106 includes a scent infusion assembly 138 coupled to the bottom surface 132. As illustrated in FIGS. 4 and 5, the scent infusion assembly 138 includes a capsule 140 with an interior chamber configured to receive a scent source 142 (e.g., oil(s) and/or gel(s)) having a scent to be diffused into the interior 118 of the container 102. In some embodiments, the scent source 142 can be handmade/hand-mixed to achieve the desired scent to be diffused into the container 102. The capsule 140 includes a bottom surface 144 (e.g., a surface that faces inwardly towards the interior 118 of the container 102 when the lid 106 is engaged with the container 102. The capsule 140 includes a top edge 146 spaced from and located on the opposite side of the capsule 140.

The capsule 140 is configured to be filled with the scent source 142, and the top edge 146 can be subsequently secured (e.g., glued with adhesive) to the bottom surface 136 of the lid 106. In some embodiments, the capsule 140 can include a removable cover that fits over the top edge 146 for sealing the scent source 142 within the capsule 140, and the cover can be secured to the bottom surface 136 of the lid 106. The capsule 140 can be detached from the lid 106 after use and can be discarded, or could alternatively be refilled and reattached to the lid 106 for additional use.

The bottom surface 144 includes one or more holes 148 that extend into the interior chamber of the capsule 140. The holes 148 allow for the scent from the scent source 142 to diffuse into the interior 118 of the container 102, thereby imparting and infusing a scent into the yarn 104 being stored in the container 102. The holes 148 are dimensioned small enough to prevent drainage of the scent source 142 from the capsule 140 and onto the yarn 104, allowing only for the scent to diffuse out of the capsule 140. In some embodiments, the scent source 142 can be viscous enough to prevent passage of the scent source 142 through the holes 148. In some embodiments, the yarn 104 placed into the container 102 can be a scent-free yarn 104, although any type of yarn 104 could be placed into the container 102 (e.g., yarn having a previous scent).

The system 100 discussed herein therefore provides for a convenient and efficient means for storage of yarn 104. The system 100 prevents or reduces entanglement of the yarn 104 during use and/or storage, and provides for a convenient configuration for removing yarn 104 from the container 102. In addition, the system 100 includes a scent infusing capsule that can be customized to diffuse a desired scent into the container 102 based on the needs of the user.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A yarn storage system, comprising:

a container including an interior configured to receive yarn;

a lid removably coupled to the container;

a scent diffusion assembly positioned within the container, the scent diffusion assembly including a scent source configured to diffuse a scent from the scent source to the yarn positioned within the container; and an inner cover movably disposed within the interior of the container and configured to be positioned over the yarn;

wherein as yarn is pulled out of the container and a size of the yarn within the interior of the container is reduced, the inner cover is configured to gradually move downward within the interior of the container.

2. The yarn storage system of claim 1, wherein the container includes a bottom surface and an opposing top edge, the top edge including an opening extending into the interior of the container.

3. The yarn storage system of claim 1, wherein the container defines a cylindrical configuration.

4. The yarn storage system of claim 1, wherein the lid includes a bottom surface and an opposing top surface, the bottom surface facing the interior of the container when the lid is removably coupled to the container.

5. The yarn storage system of claim 4, comprising an artistic design coupled to the top surface of the lid.

6. The yarn storage system of claim 5, wherein the artistic design corresponds with the scent diffused from the scent diffusion assembly.

7. The yarn storage system of claim 4, comprising a seal secured to the bottom surface of the lid.

8. The yarn storage system of claim 7, wherein the seal defines a diameter complementary to the diameter of an opening in a top surface of the container.

9. The yarn storage system of claim 7, wherein the lid removably coupled to the container creates an air tight connection between the seal and an inner surface of the container.

10. The yarn storage system of claim 4, wherein the scent diffusion assembly is removably coupled to the bottom surface of the lid.

11. The yarn storage system of claim 1, wherein the scent source is disposed within a capsule.

12. The yarn storage system of claim 11, wherein the capsule includes one or more openings formed therein, the openings permitting diffusion of the scent from the scent diffusion assembly to the interior of the container.

13. The yarn storage system of claim 1, wherein the scent source is at least one of an oil or a gel.

14. The yarn storage system of claim 1, wherein the scent source is replaceable.

15. The yarn storage system of claim 1, wherein the inner cover includes a central opening configured to receive an end of the yarn therethrough for pulling the yarn out of the container.

16. The yarn storage system of claim 1, wherein the inner cover includes a tab extending from a perimeter edge.

17. The yarn storage system of claim 1, wherein the yarn is a cake of yarn.

18. A method of yarn storage, comprising:

positioning yarn within an interior of a container of a yarn storage system, the yarn storage system including a lid and a scent diffusion assembly with a scent source;

positioning an inner cover within the interior of the container and over the yarn;

pulling yarn out of the container to reduce a size of the yarn within the interior of the container, wherein as the size of the yarn within the container is reduced, the inner cover gradually moves downward within the interior of the container;

removably coupling the lid to the container; and diffusing a scent from the scent source of the scent diffusion assembly to the yarn positioned within the container.

* * * * *